US007581484B1

(12) United States Patent
Van Dyke-Restifo et al.

(10) Patent No.: US 7,581,484 B1
(45) Date of Patent: Sep. 1, 2009

(54) WEAPON SYSTEM RETENTION DEVICE

(75) Inventors: Stephen M Van Dyke-Restifo, Voorheesville, NY (US); George D. Vitetta, Jr., Albany, NY (US); Alex Wakulenko, Cohoes, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 354 days.

(21) Appl. No.: 11/466,208

(22) Filed: Aug. 22, 2006

Related U.S. Application Data

(60) Provisional application No. 60/595,974, filed on Aug. 22, 2005.

(51) Int. Cl.
*F41A 9/45* (2006.01)

(52) U.S. Cl. ..... 89/45; 89/33.01; 89/34

(58) Field of Classification Search ..... 89/1.35, 89/37.05, 40.02, 14.05, 27.11, 33.01, 45, 89/46, 47; 74/25, 55
See application file for complete search history.

(56) References Cited

U.S. PATENT DOCUMENTS

| | | | | | |
|---|---|---|---|---|---|
| 23,258 | A * | 9/1859 | Moore | 89/45 |
| 613,179 | A * | 10/1898 | Vickers | 89/45 |
| 1,098,261 | A * | 5/1914 | Hermsdorf | 89/45 |
| 1,464,824 | A * | 8/1923 | Kollock et al. | 74/55 |
| 1,985,185 | A * | 12/1934 | Methlin | 89/27.13 |
| 4,316,569 | A * | 2/1982 | Gentile | 226/158 |
| 4,597,567 | A * | 7/1986 | Racca | 267/140.2 |
| 5,406,859 | A * | 4/1995 | Belford | 74/31 |
| 6,095,443 | A * | 8/2000 | Haikkala et al. | 241/186.1 |
| 6,109,550 | A * | 8/2000 | Haikkala et al. | 241/27 |
| 6,513,415 | B2 * | 2/2003 | Vaske et al. | 89/45 |
| 6,758,109 | B2 * | 7/2004 | Nakakado | 74/57 |
| 7,040,211 | B1 * | 5/2006 | Bennett et al. | 89/1.35 |
| 2007/0234898 | A1 * | 10/2007 | Boyl-Davis et al. | 91/306 |

* cited by examiner

*Primary Examiner*—Michael Carone
*Assistant Examiner*—Reginald Tillman, Jr.
(74) *Attorney, Agent, or Firm*—Henry S. Goldfine

(57) ABSTRACT

An apparatus for retaining an object in a gun tube of a weapon system, the gun tube having a longitudinal axis, a chamber and a breech ring with an opening therein, the apparatus including a plunger that reciprocates in the opening in the breech ring and the chamber; a housing fixed in the opening in the breech ring, the housing holding the plunger; and means for reciprocating the plunger in the opening in the breech ring and the chamber. The object to be retained is propellant. The reciprocating means is automatically operated via electrical and/or mechanical connections to the weapon system.

11 Claims, 10 Drawing Sheets

WEAPON SYSTEM RETENTION DEVICE

CROSS-REFERENCE TO RELATED APPLICATIONS

This application claims the benefit under 35 USC 119(e) of U.S. provisional patent application 60/595,974 filed on Aug. 22, 2005, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to weapon systems and in particular to a retention device for positioning propellant and/or ammunition in guns.

The problem of how to hold munitions in an open cannon chamber has existed for as long as cannons have been used. A common method is to de-elevate the cannon to a horizontal position between firings. This method drastically reduces the number of rounds fired per minute because of the time needed to reposition the cannon for firing. Another method used to hold propellant in an elevated chamber is the Swiss notch. The Swiss notch is basically a notch cut into the chamber of the cannon at the six o'clock position. The notch is designed so that propellant bags or charge modules will catch on the notch if they begin to fall out of the chamber due to gravity. The Swiss notch is only somewhat effective because it is totally dependent on the drop angle, weight, and profile of the propellant bag or module to fall uncontrolled into the notch. At higher angles, the propellant bag or module may not fall into the notch. In addition, experience has shown that the Swiss notch is not a foolproof method to keep the propellant bag or charge modules from falling out of the chamber at any elevated angle. Further, the combustion debris may fill the notch and render it useless.

In a breech-loaded cannon, it is most efficient to load propellant bags or charge modules using a device such as an automatic loader. Typically, the propellant bags or modules are loaded with the cannon muzzle at an elevated angle. However, upon withdrawal of the auto-loader ram, the propellant can fall out of the chamber due to the elevated muzzle.

SUMMARY OF THE INVENTION

It is an object of the invention to provide a device to hold propellant inside a firing chamber until the breech is closed.

It is another object of the invention to provide a device to hold propellant inside a firing chamber without having to lower the muzzle, load the cannon and then reposition the muzzle.

It is a further object of the invention to provide a device to hold propellant inside a firing chamber wherein the device operates automatically.

One aspect of the invention is an apparatus for retaining an object in a gun tube of a weapon system, the gun tube having a longitudinal axis, a chamber and a breech ring with an opening therein, the apparatus comprising a plunger that reciprocates in the opening in the breech ring and the chamber; a housing fixed in the opening in the breech ring, the housing holding the plunger; and means for reciprocating the plunger in the opening in the breech ring and the chamber.

In one embodiment, the weapon system includes a non-recoil surface and the means for reciprocating the plunger includes a compression spring disposed around the plunger and a solenoid fixed to the non-recoil surface such that, when activated, the solenoid is operable to move the plunger into the chamber and, when deactivated, the compression spring moves the plunger out of the chamber.

In a second embodiment, the weapon system includes a breech crankshaft and the means for reciprocating the plunger includes a drive gear attached to the breech crankshaft; a fixed shaft having a driven gear mounted thereon that meshes with the drive gear; a cam mounted on the fixed shaft and including a cam path; and a cam follower fixed to the plunger and operable to follow the cam path of the cam.

In a third embodiment, the weapon system includes a breech crankshaft and the means for reciprocating the plunger includes a cam mounted on the breech crankshaft and including a cam path; a cam lever having one end rotatably attached to the housing and another end with an opening formed therein; a first cam follower fixed to the plunger and disposed in the opening in the cam lever; and a second cam follower mounted on the cam lever and operable to follow the cam path of the cam.

Another aspect of the invention is a method of retaining an object in a gun tube of a weapon system, the gun tube having a longitudinal axis, a chamber and a breech ring with an opening therein, the method comprising placing the object in the gun tube; and moving a plunger through the opening in the breech ring and into the chamber such that a portion of the plunger contacts a rear surface of the object.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention holds propellant bags or propellant modules inside the firing chamber of a gun until the breech is closed. The cannon is loaded at an elevated muzzle angle without having to lower the muzzle, load the cannon, and reposition the muzzle. Because some loading steps are eliminated, the invention is faster and safer than known methods. A paddle-like retaining device is introduced at the firing chamber entrance to hold the propellant in place. The retaining device may be mechanically, electrically and/or hydraulically inserted into the firing chamber.

In some embodiments, the retaining device is activated during the mechanical action of opening and closing the breech by using an electrically operated solenoid, hydraulic actuator or cam action. During firing, the retaining device is in the retracted position away from the chamber opening. After firing, the breech is opened and the projectile and propellant modules are loaded into the chamber for the next round. When the propellant modules have been placed into the firing chamber, the load ram is extracted and the retaining device is actuated. The retaining device may extend through a port in the breech ring and thence into the chamber access area to hold the propellant in place. The retaining device may be actuated in various ways.

Figure 1A:
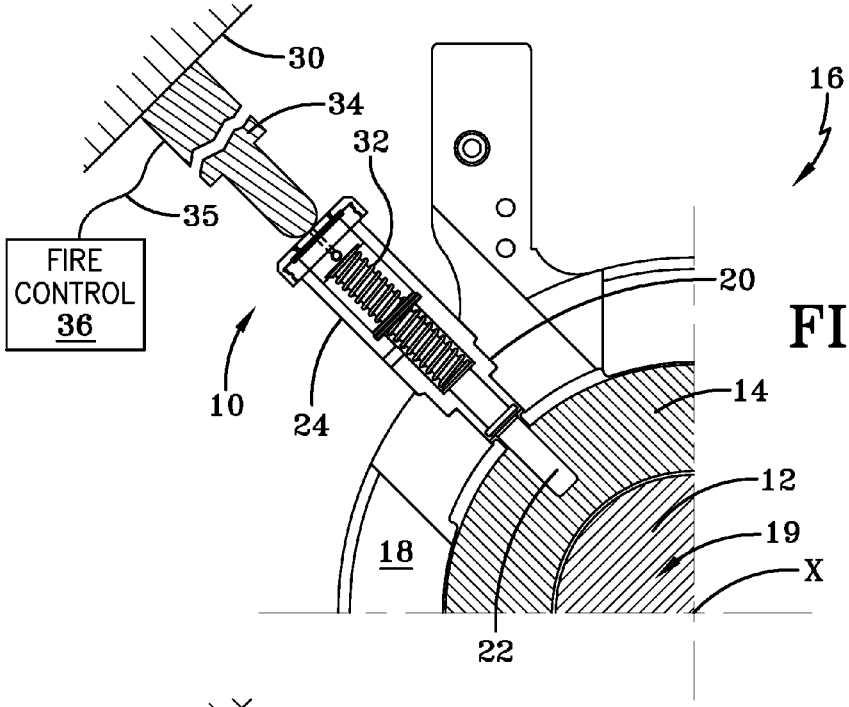
FIGS. 1A and 1B are sectional, schematic views of one embodiment of the invention in a deactivated and an activated mode, respectively.
Figure 1B:
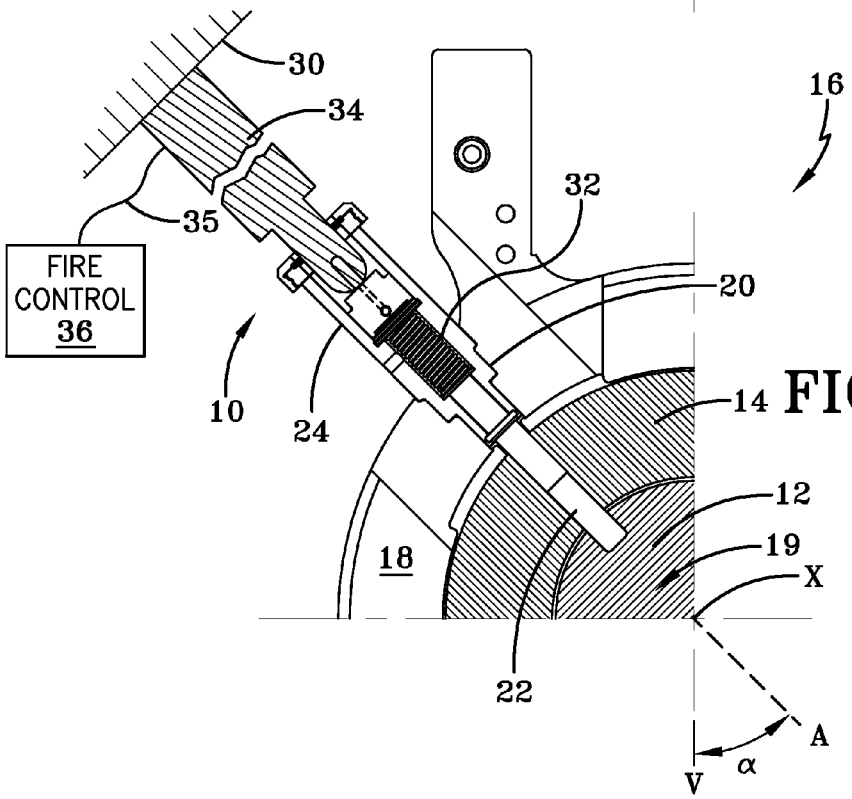

FIGS. 1A and 1B are sectional, schematic views of one embodiment of the invention in a deactivated and an activated mode, respectively. In FIGS. 1A and 1B, the view is from the breech end of the gun tube 14 looking forward. Apparatus 10 functions to retain an object 12 in the chamber 19 of a gun tube 14 of a weapon system 16. The gun tube 14 has a longitudinal axis X and a breech ring 18 with an opening 20 therein. The apparatus 10 includes a plunger 22 that reciprocates in the breech ring 18 and the chamber 19, and a housing 24 fixed in the opening 20 in the breech ring 18. Housing 24 holds the plunger 22. Apparatus 10 further includes a means for reciprocating the plunger 22 in the breech ring 18.

Figure 3:
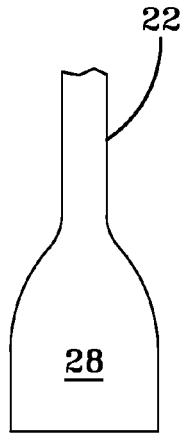
FIG. 3 is a view of one end of a plunger.

In FIGS. 1A and 1B, the object 12 to be retained or positioned in the gun tube 14 is typically propellant, such as a bag or charge module. To effectively retain the object 12 in the tube 14 against the force of gravity, the end of the plunger 22 that contacts the object 12 may include an increased area portion 28, as shown in FIG. 3. The increased area portion 28 contacts the rear end of the object 12 and prevents the object 12 from sliding rearward to the breech of the gun tube 14.

The weapon system 16 includes a non-recoil surface 30. In the embodiment of FIGS. 1-2, the means for reciprocating the plunger 22 includes a compression spring 32 disposed around the plunger 22 and a solenoid 34 fixed to the non-recoil surface 30. When activated, as in FIG. 1B, the solenoid 34 is operable to move the plunger 22 into the gun chamber 19. When deactivated, as in FIG. 1A, the compression spring 32 moves the plunger 22 out of the gun chamber 19. The weapon system 16 includes a fire control system 36 shown schematically in FIGS. 1A and 1B as a box. The fire control system 36 is connected to the solenoid 34 via wire 35, for activating and deactivating the solenoid 34.

The solenoid 34 is actuated after the propellant is loaded into the gun tube 14, causing the plunger 22 to extend into the breech chamber 19 behind the propellant, thereby holding the propellant 12 in place. Just prior to full closure of the breech, the solenoid 34 is deactivated and the plunger 22 is retracted. Plunger 22 remains retracted until the weapon system 16 has fired, the breech is reopened and a new charge is loaded into the gun tube. As best seen in FIG. 1B, a vertical plane V through tube 14 intersects a longitudinal axis A of plunger 22 forming an angle alpha. In one embodiment, it is preferred that alpha is about thirty-eight degrees. Of course, other angles may be used.

Figure 2A:
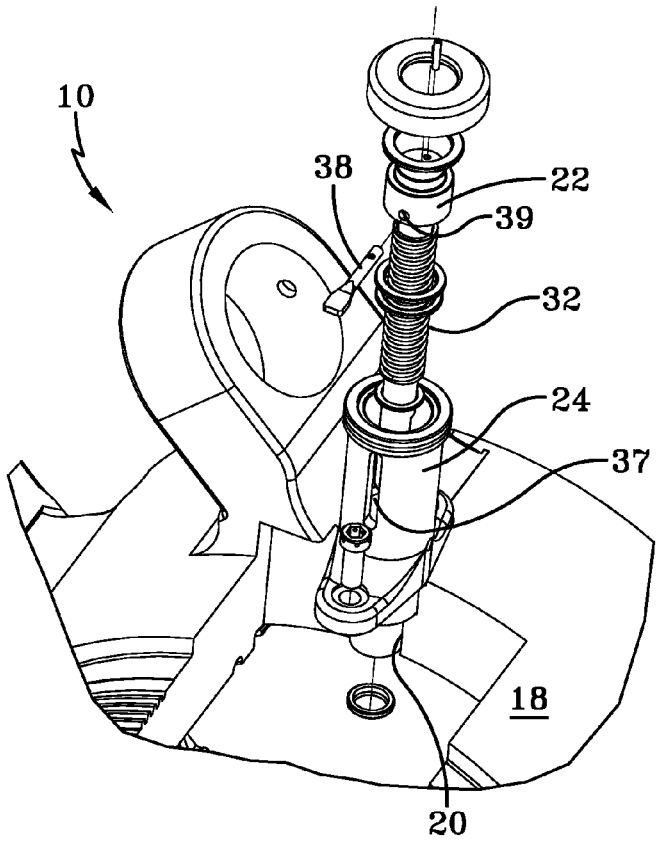
FIGS. 2A and 2B are exploded and assembled perspective views, respectively, of the embodiment of FIGS. 1A and 1B.
Figure 2B:
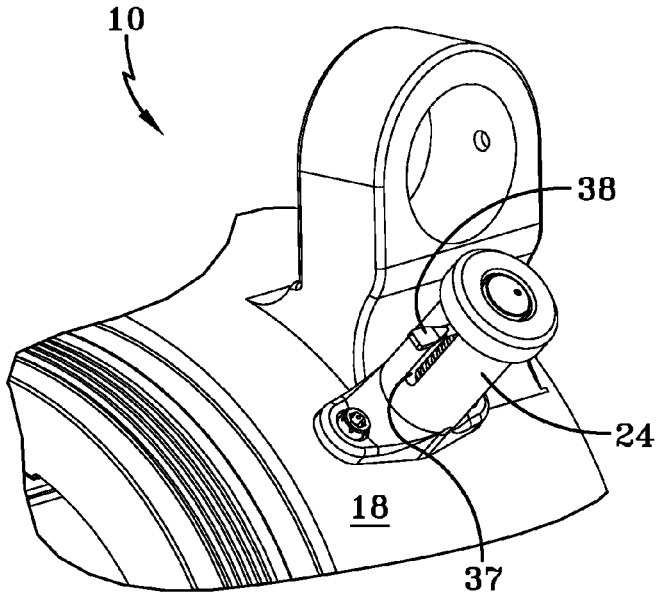

FIGS. 2A and 2B are exploded and assembled perspective views, respectively, of the apparatus 10 of FIGS. 1A and 1B. In FIG. 2A, the view is from the front of the gun tube looking rearward toward the breech. In FIG. 2B, the view is an angled view from the front looking rearward. FIGS. 2A and 2B do not show the solenoid 34, the non-recoil surface 30 or the fire control system 36.

As best seen in FIGS. 2A and 2B, apparatus 10 includes an indicator tab 38 inserted in a hole 39 in plunger 22. Indicator tab 38 moves up and down in slot 37 of housing 24 with plunger 22. Thus, indicator tab 38 may be used as a check on the position of plunger 22. For example, indicator tab 38 may comprise a magnetic material and a magnetic sensor may be mounted adjacent housing 24 to sense the position of indicator tab 38. The magnetic sensor may be connected to the fire control system 36 (FIGS. 1A and 1B) such that an incorrect position of plunger 22 stops the operation of weapon system 16.

Figure 4A:
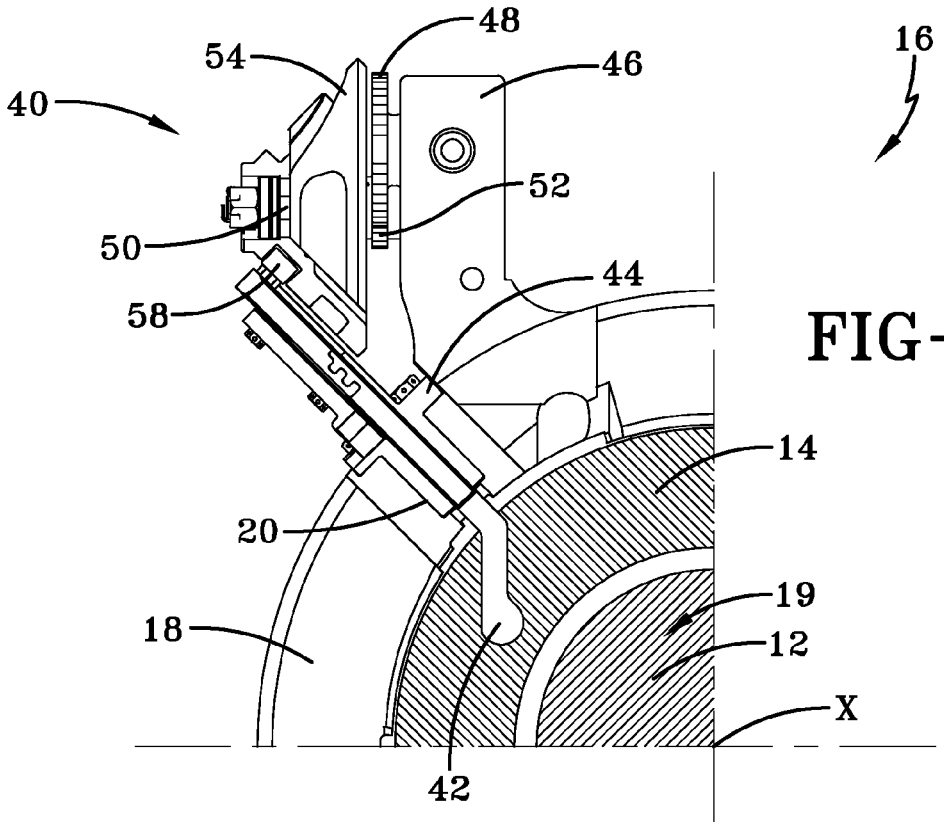
FIGS. 4A and 4B are sectional views of a second embodiment of the invention in a deactivated and an activated mode, respectively.
Figure 4B:
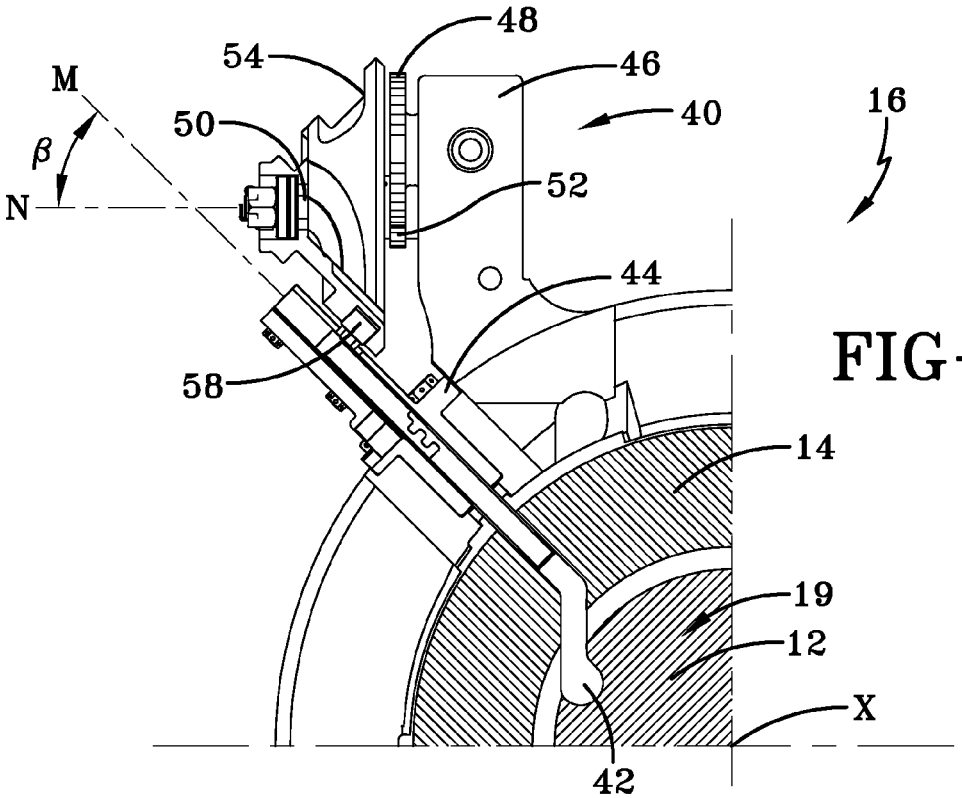

FIGS. 4A and 4B are sectional, schematic views of a second embodiment of the invention in a deactivated and an activated mode, respectively. In FIGS. 4A and 4B, the view is from the breech end of the gun tube looking forward. The apparatus 40 functions to retain an object 12 in the chamber 19 of a gun tube 14 of a weapon system 16. The gun tube 14 has a longitudinal axis X and a breech ring 18 with an opening 20 therein. The apparatus 40 includes a plunger 42 that reciprocates in the breech ring 18 and chamber 19, and a housing 44 fixed in the opening 20 in the breech ring 18. Housing 44 holds the plunger 42. Apparatus 40 further includes a means for reciprocating the plunger 42 in the gun breech ring 18 and chamber 19.

Figure 5:
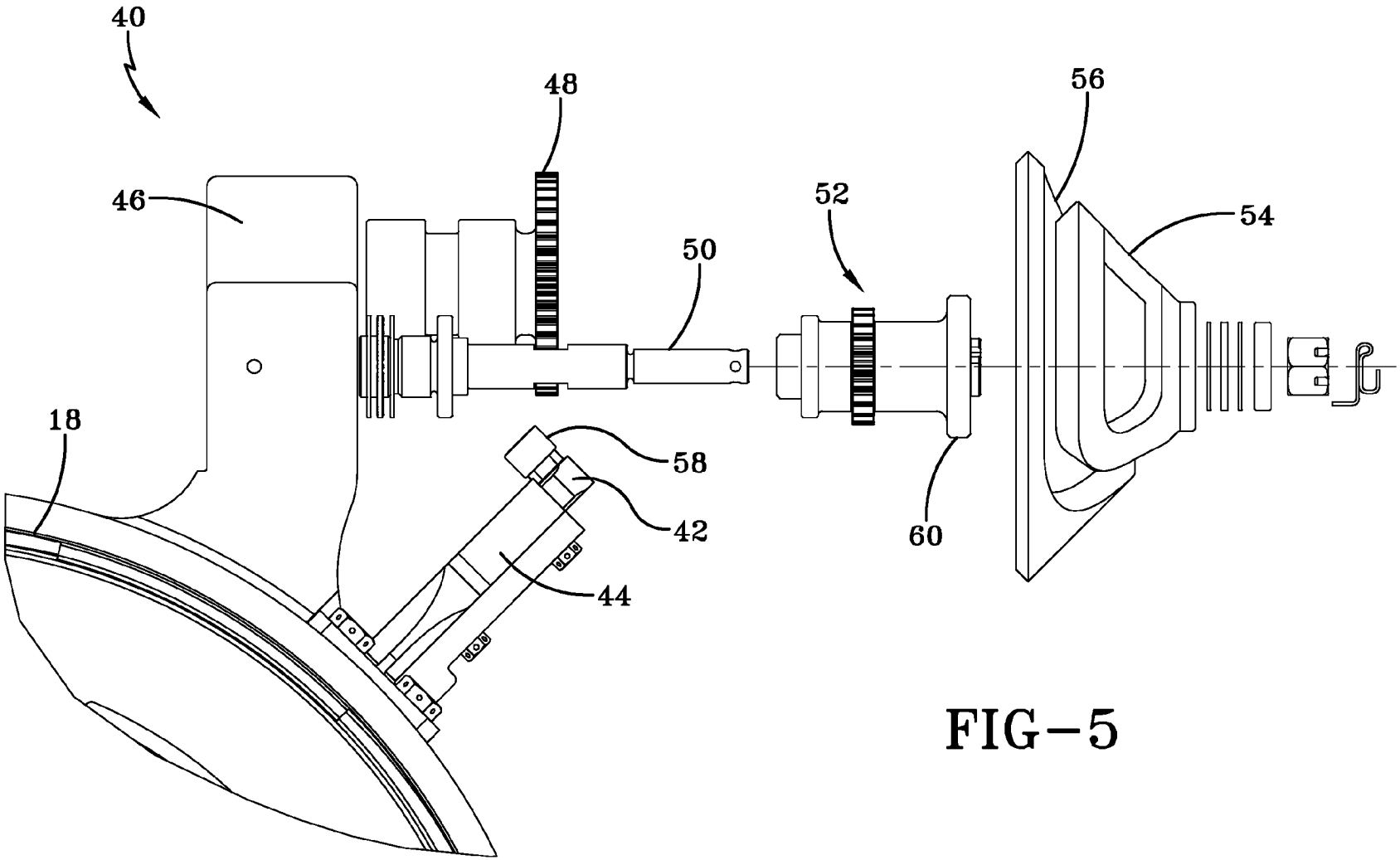
FIG. 5 is an exploded view of the second embodiment.

Weapon system 16 includes a breech crankshaft (not shown) that fits through lug 46. The means for reciprocating the plunger 42 includes a drive gear 48 attached to the breech crankshaft; a driven gear 52 that meshes with and is driven by the drive gear 48, the driven gear 52 being rotatably mounted on a fixed shaft 50; a cam 54 mounted on the fixed shaft 50 and including a cam path 56 (FIG. 5); and a cam follower 58 fixed to the plunger 42 and operable to follow the cam path 56 (FIG. 5) of the cam 54. As shown in FIG. 5, the cam 54 comprises a generally conical shape and includes the cam path 56 on an external surface thereof.

FIG. 5 is an exploded view of the second embodiment, viewed from the front of the gun tube looking rearward. Both the drive gear 48 and the fixed shaft 50 have been shifted to the right in FIG. 5. One end of the driven gear 52 includes a flange 60 that mates with a recess 74 (FIG. 8C) in the interior of cam 54 to drive the cam 54. As shown in FIG. 4B, an angle beta between a longitudinal axis M of the plunger 42 and an axis of rotation N of the fixed shaft 50 is an acute angle. Preferably, the angle beta is about 45 degrees. Details of apparatus 40 are further seen in the perspective views of FIGS. 6A-6C.

Figure 6A:
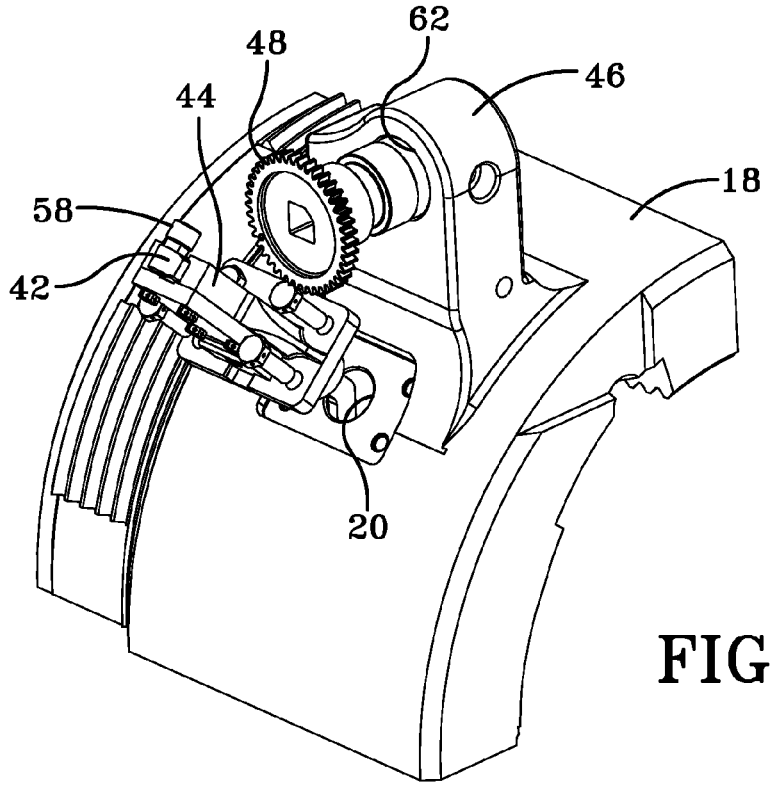
FIG. 6A shows a housing and drive gear assembly of the second embodiment.
Figure 6B:
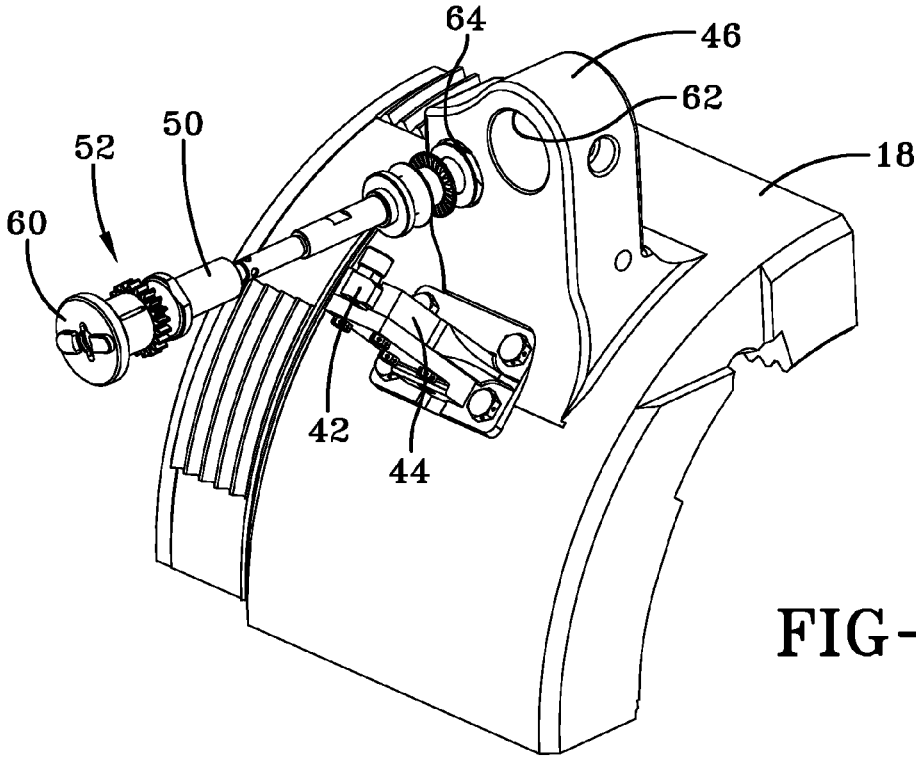
FIG. 6B shows the driven gear and fixed shaft assembly of the second embodiment.
Figure 6C:
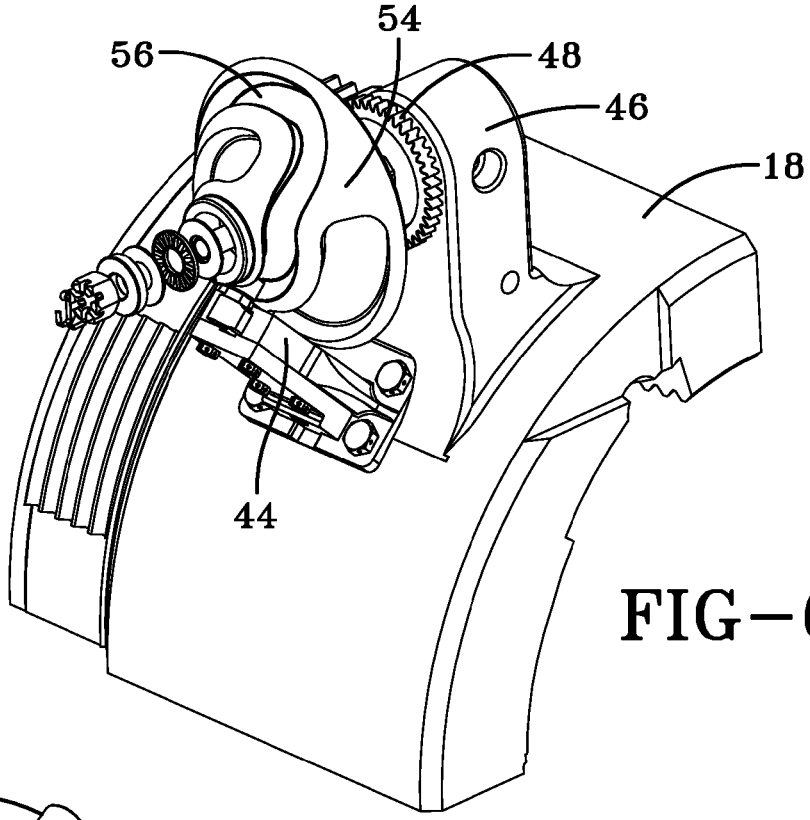
FIG. 6C shows the cam assembly of the second embodiment.

FIG. 6A shows the housing 44 and plunger 42 lifted away from breech ring 18 to show the opening 20 in breech ring 18. The drive gear 48 is shown removed from breech lug 46. The breech crankshaft (not shown) engages drive gear 48 on the opposite side of breech lug 46. The driven gear 52, fixed shaft 50 and cam 54 are not shown in FIG. 6A. FIG. 6B shows the driven gear 52 and the fixed shaft 50. Drive gear 48 (FIG. 6A) drives driven gear 52 thereby rotating the flange 60. Flange 60 engages the interior 74 (FIG. 8C) of cam 54 and drives cam 54. Drive gear 48 (FIG. 6A) is supported in opening 62 in breech lug 46 and fixed shaft 50 is supported in a second opening 64 in lug 46. FIG. 6C shows the cam 54 assembled to the fixed shaft 50 (located inside of cam 54).

Figure 7:
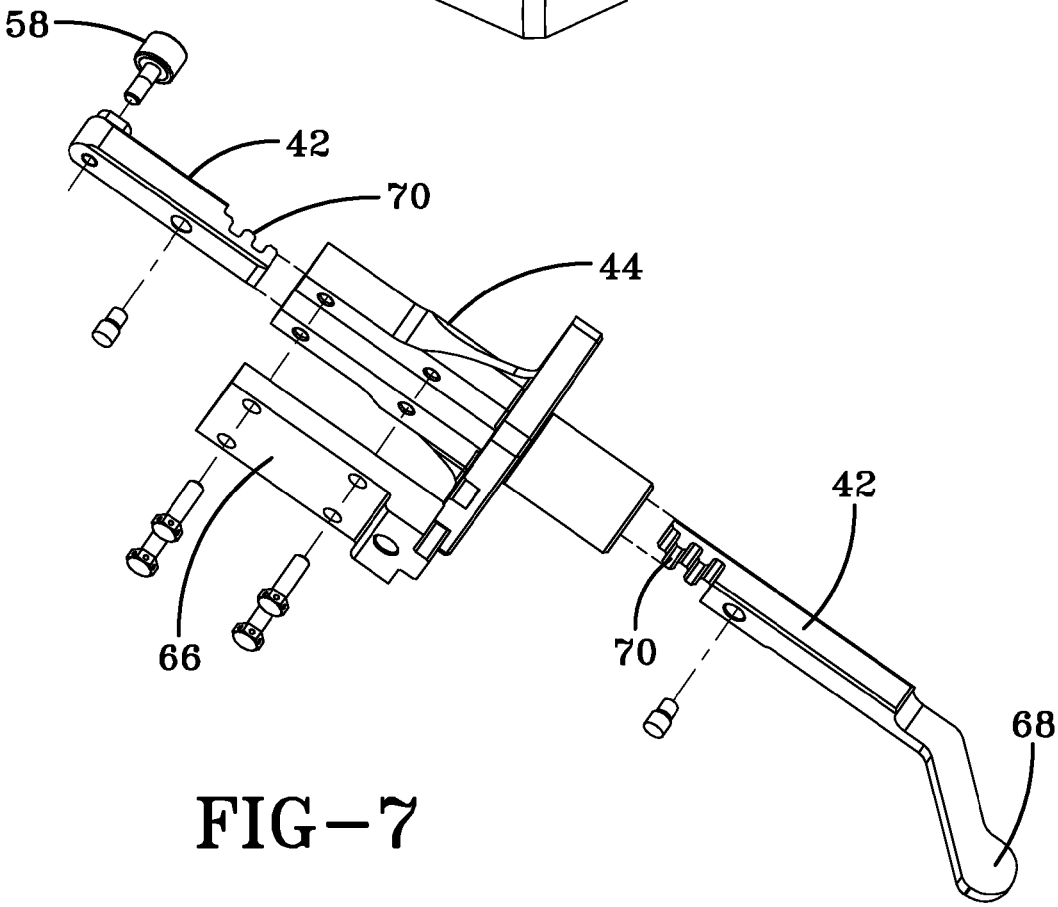
FIG. 7 is an exploded view of the housing and plunger of the second embodiment.

FIG. 7 is an exploded view of housing 44 and plunger 42. Plunger 42 is formed in two parts with ribs or teeth 70 that mesh together in housing 44. Plate 66 secures plunger 42 in housing 44. The lower end of plunger 42 includes the portion 68 that contacts the object in the chamber 19. The portion 68 is generally widened to increase the area of contact and may be bent as needed.

Figure 8B:
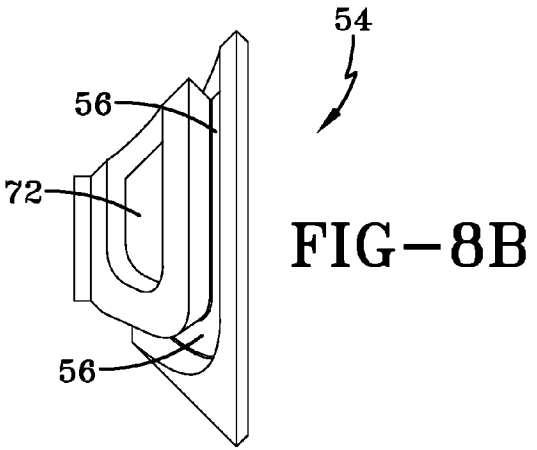
FIGS. 8A-8D are top, side, interior perspective and exterior perspective views, respectively, of a cam of the second embodiment.
Figure 8D:
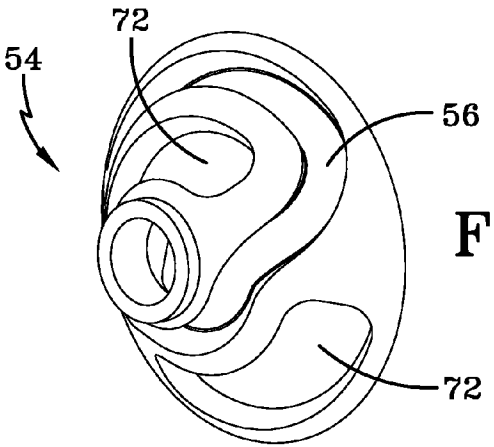
Figure 8A:
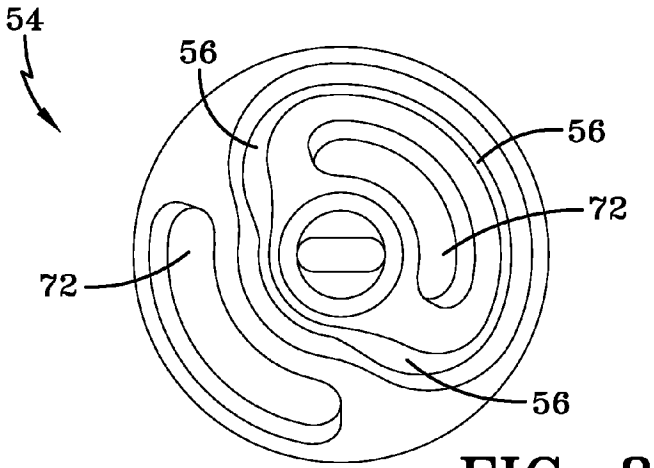
Figure 8C:
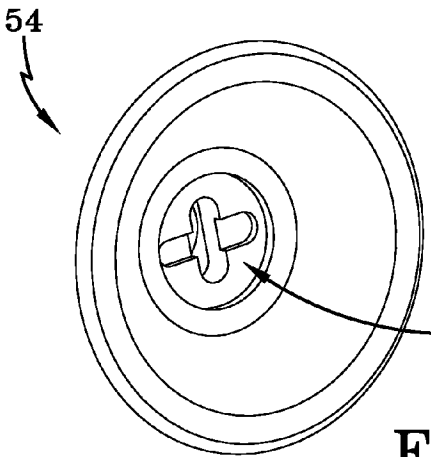

FIGS. 8A-8D are top, side, interior and perspective views, respectively, of cam 54 showing three-dimensional cam path 56. Cutouts 72 reduce the weight of cam 54. Flange 60 (FIG. 6B) of fixed shaft 50 (FIG. 6B) engages cam 54 in its interior at 74 (FIG. 8C).

Figure 9A:
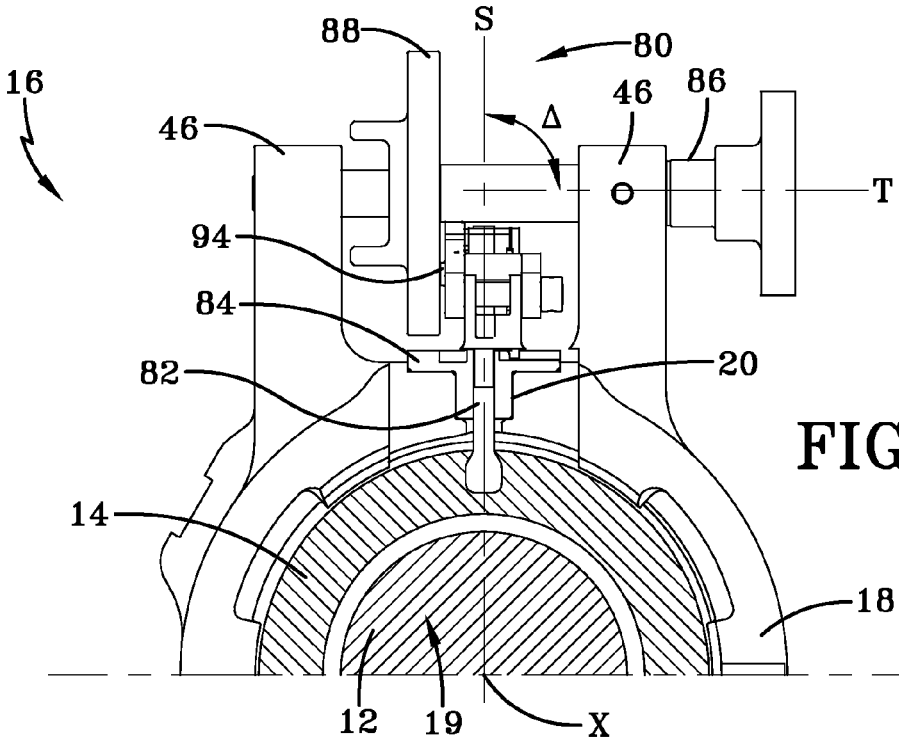
FIGS. 9A and 9B are sectional views of a third embodiment of the invention in a deactivated and an activated mode, respectively.
Figure 9B:
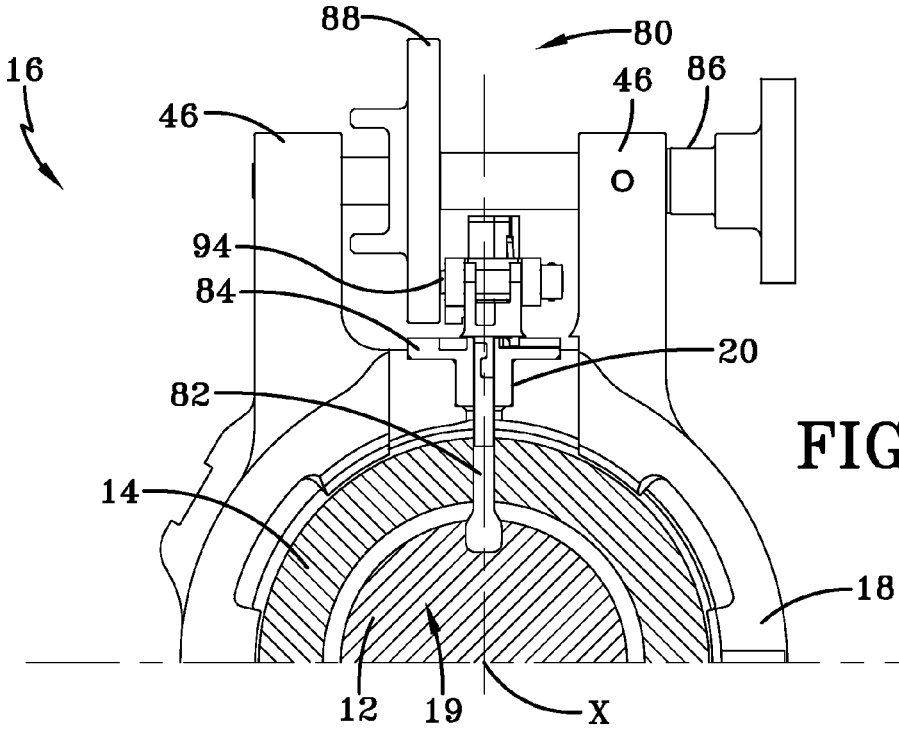
Figure 10A:
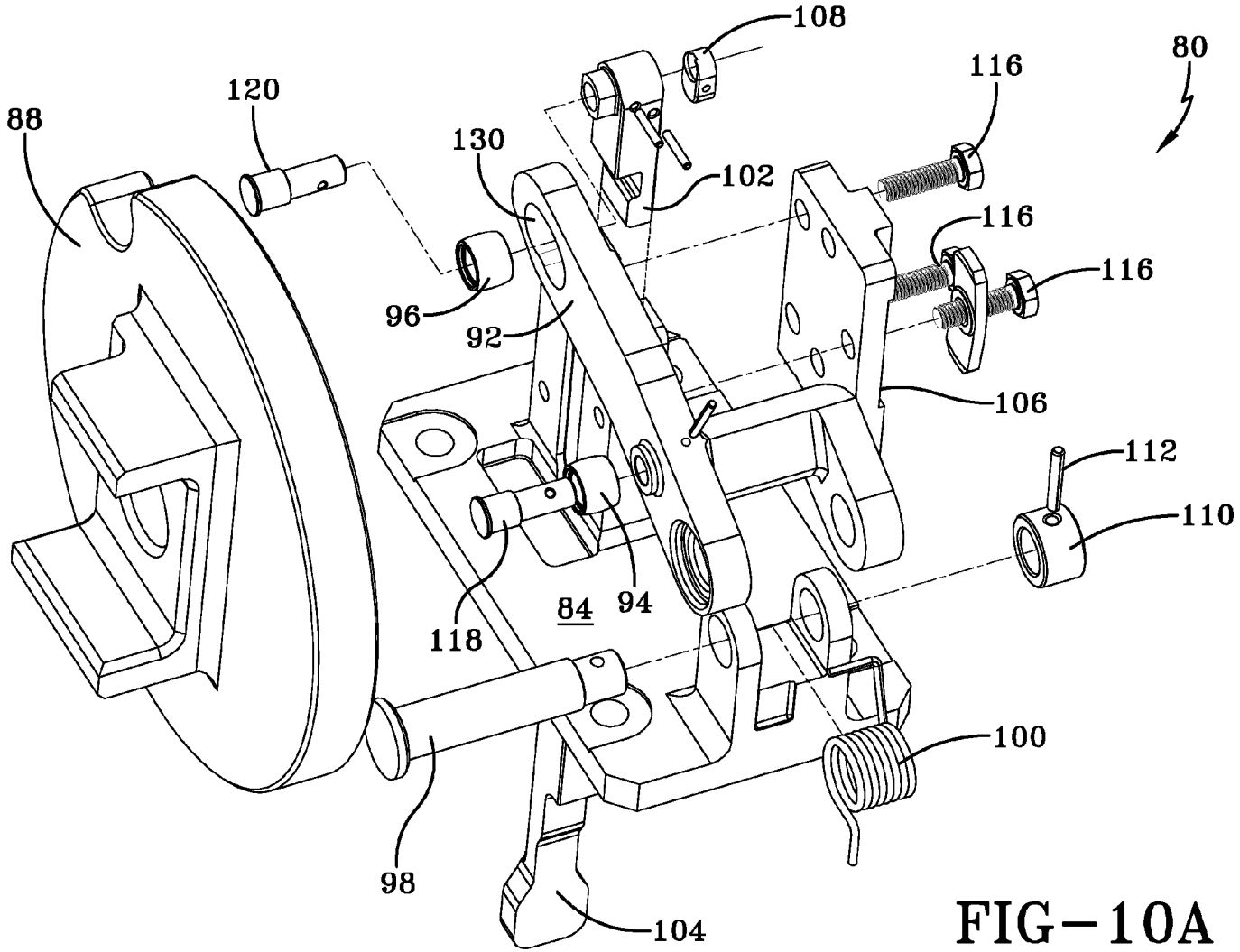
FIGS. 10A and 10B are exploded, perspective views of the third embodiment.
Figure 10B:
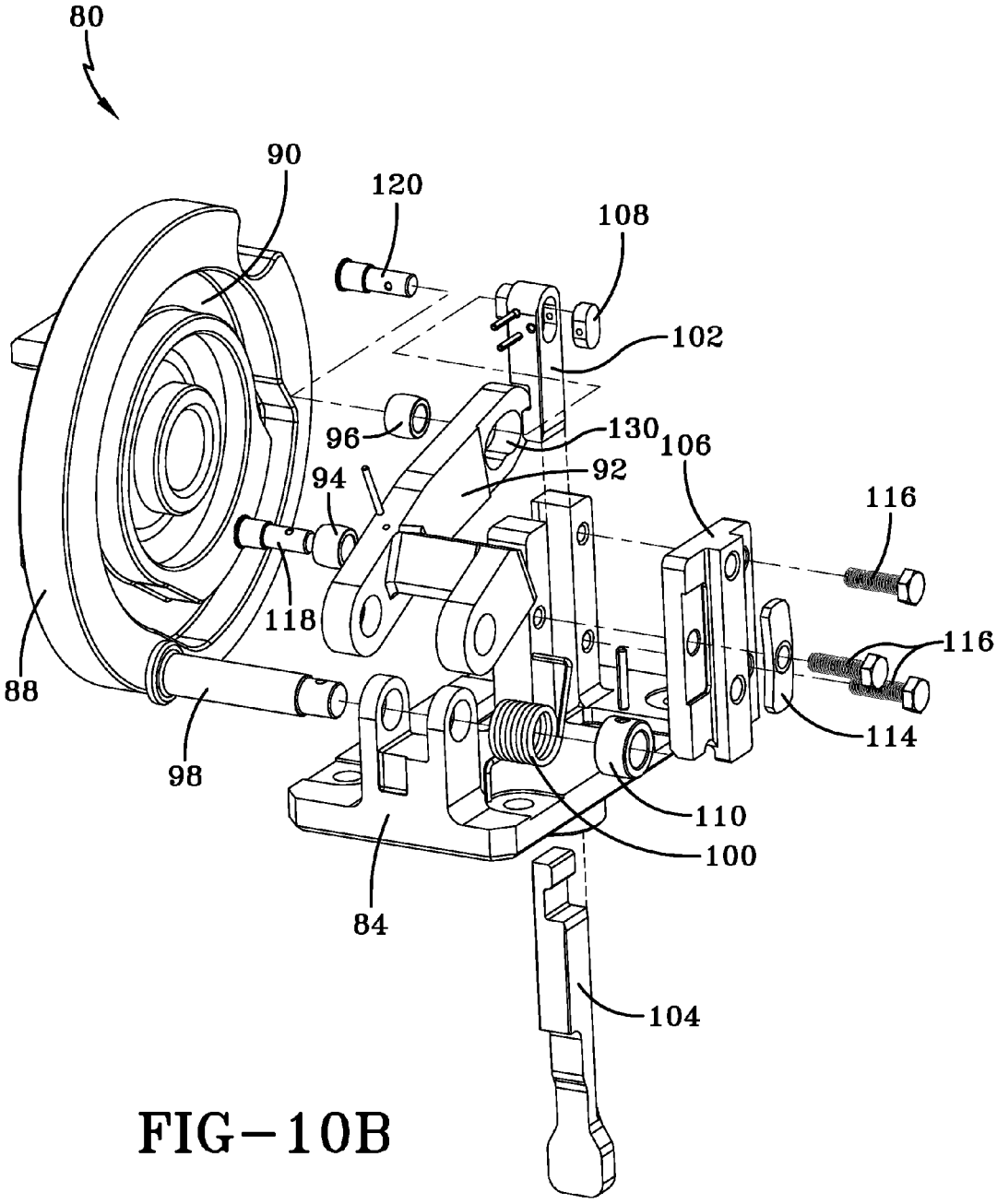

FIGS. 9A and 9B are sectional views of a third embodiment of the invention in a deactivated and an activated mode, respectively. In FIGS. 9A and 9B, the view is from the rear of the gun looking forward. FIGS. 10A and 10B are exploded, perspective views of the third embodiment. The third embodiment is an apparatus 80 that functions to retain an object 12 in a chamber 19 of a gun tube 14 of a weapon system 16. The gun tube 14 has a longitudinal axis X and a breech ring 18 with an opening 20 therein. The apparatus 80 includes a plunger 82 that reciprocates in the breech ring 18 and the chamber 19, and a housing 84 fixed in the opening 20 in the breech ring 18. Housing 84 holds the plunger 82. Apparatus 80 further includes a means for reciprocating the plunger 82 in the breech ring 18.

Weapon system 16 includes a breech crankshaft 86 that fits through breech ring lugs 46. The means for reciprocating the plunger 82 includes a cam 88 mounted on the breech crankshaft 86 and rotated by the carrier (not shown). Cam 88 is generally disc shaped and includes a cam path 90 (FIG. 10B) formed on one side. A cam lever 92 (FIG. 10A) has one end rotatably attached to the housing 84 using cam lever shaft 98. Torsion spring 100 provides a biasing force to the cam lever 92.

The other end of cam lever 92 includes an opening 130 therein. Cam follower 96 is fixed to the plunger 82 (FIGS. 9A and 9B) with cam shaft 120. Cam follower 96 rides in opening 130 in cam lever 92 and moves the plunger 82 up and down as the cam lever 92 rotates about cam lever shaft 98. Cam follower 94 is connected to the cam lever 92 with cam shaft 118 and rides in cam path 90 (FIG. 10B). As shown in FIG. 9A, an angle delta between the longitudinal axis S of the plunger 82 and an axis of rotation T of the breech crankshaft 86 is about ninety degrees.

Further details of the assembly of apparatus 80 are seen in FIGS. 10A and 10B. Plunger 82 (FIG. 9A) comprises a split rod with an upper portion 102 and a lower portion 104. Housing cover plate 106 confines plunger 82 (FIG. 9A) in housing 84. A steel plug 108 functions as a target for proximity sensors (not shown) that are placed in the top and bottom of the housing cover plate 106. As the upper portion 102 of the plunger 82 moves up and down, the proximity sensors (not shown) in the housing cover plate 106 sense the presence or absence of the steel plug 108 and thereby provide an indication of the location of plunger 82, that is, activated (FIG. 9B) or deactivated (FIG. 9A). Cam lever shaft 98 is provided with a bushing 110 and spring pin 112. A housing plate washer 114 and bolts 116 are used to attach housing cover plate 106 to housing 84. Cam followers 94, 96 ride on cam follower shafts 118, 120.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for retaining a propellant in the firing chamber, within an elevated gun tube of a weapon system, the propellant having a back side disposed closest to and facing the breech of the gun, the gun tube having a longitudinal axis, and a breech ring with an opening therein, the apparatus comprising;

a plunger that reciprocates in the opening in the breech ring and the chamber;

a housing fixed in the opening in the breech ring, the housing holding the plunger; a non-recoil surface; and means for reciprocating the plunger in the opening in the breech ring and the chamber, the means includes a compression spring disposed around the plunger and a solenoid fixed to the non-recoiling surface such that, when activated, the solenoid is operable to move the plunger into the chamber and, when deactivated, the compression spring moves the plunger out of the chamber;

whereby, said plunger reciprocates into said chamber and contacts therein the back side of said propellant, thereby holding said propellant in place until prior to firing, at which time the plunger is withdrawn from said chamber and said weapon system is fired.

2. The apparatus of claim 1 wherein the weapon system includes a fire control system connected to the solenoid for activating and deactivating the solenoid.

3. An apparatus for retaining a propellant in the firing chamber, within an elevated gun tube of a weapon system, the propellant having a back side disposed closest to and facing the breech of the gun, the gun tube having a longitudinal axis, and a breech ring with an opening therein, the apparatus comprising:

a plunger that reciprocates in the opening in the breech ring and the chamber;

a housing fixed in the opening in the breech ring, the housing holding the plunger; a breech crankshaft; and means for reciprocating the plunger in the opening in the breech ring and the chamber, the means includes a drive gear attached to the breech crankshaft; a fixed shaft having a driven gear mounted thereon that meshes with the drive gear; a cam mounted on the fixed shaft and including a cam path; and a cam follower fixed to the plunger and operable to follow the cam path of the cam;

whereby, said plunger reciprocates into said chamber and contacts therein the back side of said propellant, thereby holding said propellant in place until prior to firing, at which time the plunger is withdrawn from said chamber and said weapon system is fired.

4. The apparatus of claim 3 wherein the cam comprises a generally conical shape and includes the cam path on an external surface thereof.

5. The apparatus of claim 4 wherein an angle between a longitudinal axis of the plunger and an axis of rotation of the fixed shaft is an acute angle.

6. The apparatus of claim 5 wherein the acute angle is 45 degrees.

7. The apparatus of claim 3 wherein one end of the drive gear includes a flange thereon that mates with a recess in the cam to drive the cam.

8. An apparatus for retaining a propellant in the firing chamber, within an elevated gun tube of a weapon system, the propellant having a back side disposed closest to and facing the breech of the gun, the gun tube having a longitudinal axis, and a breech ring with an opening therein, the apparatus comprising:

a plunger that reciprocates in the opening in the breech ring and the chamber;

a housing fixed in the opening in the breech ring, the housing holding the plunger; a breech crankshaft; and means for reciprocating the plunger in the opening in the breech ring and the chamber, the means includes a cam mounted on the breech crankshaft and including a cam path; a cam lever having one end rotatably attached to the housing and another end with an opening formed therein; a first cam follower fixed to the plunger and disposed in the opening in the cam lever; and a second cam follower mounted on the cam lever and operable to follow the cam path on the cam;

whereby, said plunger reciprocates into said chamber and contacts therein the back side of said propellant, thereby holding said propellant in place until prior to firing, at which time the plunger is withdrawn from said chamber and said weapon system is fired.

9. The apparatus of claim 8 wherein the cam comprises a generally disc shape and includes the cam path on an external surface thereof.

10. The apparatus of claim 8 wherein the cam lever includes a torsion spring for biasing the cam lever.

11. The apparatus of claim 9 wherein an angle between a longitudinal axis of the plunger and a axis of rotation of the breech crankshaft is about ninety degrees.

* * * * *